US011781500B2

(12) United States Patent
Albing et al.

(10) Patent No.: US 11,781,500 B2
(45) **Date of Patent: *Oct. 10, 2023**

(54) SYSTEM AND METHOD FOR MEASURING FUEL INJECTION DURING PUMP OPERATION

(71) Applicant: Cummins Inc., Columbus, IN (US)

(72) Inventors: Tommy J. Albing, Columbus, IN (US); David Michael Carey, Bend, OR (US)

(73) Assignee: Cummins Inc., Columbus, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/954,615

(22) Filed: Sep. 28, 2022

(65) Prior Publication Data

US 2023/0015452 A1 Jan. 19, 2023

Related U.S. Application Data

(63) Continuation of application No. 17/508,475, filed on Oct. 22, 2021, now Pat. No. 11,499,495, which is a (Continued)

(51) Int. Cl.
*F02D 41/38* (2006.01)
*F02D 41/24* (2006.01)

(Continued)

(52) U.S. Cl.
CPC ..... *F02D 41/3845* (2013.01); *F02D 41/2467* (2013.01); *F02D 2041/2055* (2013.01);

(Continued)

(58) Field of Classification Search
CPC ..... F02D 41/247; F02D 41/2467; F02D 41/3845; F02D 2041/224; F02D 2041/225;

(Continued)

(56) References Cited

U.S. PATENT DOCUMENTS 6,250,285 B1 6/2001 Takase
6,349,702 B1 2/2002 Nishiyama (Continued)

FOREIGN PATENT DOCUMENTS

DE 102008016662 A1 10/2009
WO 2017091140 A1 6/2017

OTHER PUBLICATIONS

International Search Report and Written Opinion issued by the ISA/US, Commissioner for Patents, dated Jun. 13, 2018, for International Application No. PCT/US2018/026874; 6 pgs.

(Continued)

*Primary Examiner* — John Kwon
(74) *Attorney, Agent, or Firm* — Taft Stettinius & Hollister LLP

(57) ABSTRACT

A method is disclosed of controlling operation of a fuel injector in response to measuring a quantity of fuel injected by the fuel injector from a fuel accumulator to an engine cylinder during operation of a fuel pump that delivers fuel to the accumulator, comprising: determining an average pressure of the fuel accumulator during a first time period before a fuel injection event; predicting a mass of fuel delivered to the fuel accumulator during a pumping event ($Q_{pump}$); determining an average pressure of the fuel accumulator during a second time period after the fuel injection event; estimating a leakage of fuel; computing the injected fuel quantity by adding the average pressure during the first time period to $Q_{pump}$, and subtracting the average pressure during the second time period and the leakage; and using the computed injected, fuel quantity to control operation of the fuel injector.

21 Claims, 2 Drawing Sheets

Related U.S. Application Data continuation of application No. 17/046,969, filed as application No. PCT/US2018/026874 on Apr. 10, 2018, now Pat. No. 11,162,450.

(51) Int. Cl.
*F02D 41/20* (2006.01)
*F02D 41/22* (2006.01)

(52) U.S. Cl.
CPC ..... *F02D 2041/225* (2013.01); *F02D 2200/0602* (2013.01); *F02D 2200/0606* (2013.01); *F02D 2250/31* (2013.01)

(58) Field of Classification Search
CPC ..... F02D 2041/2055; F02D 2200/0606; F02D 220/0602; F02D 2250/31
See application file for complete search history.

(56) References Cited

U.S. PATENT DOCUMENTS

| | | | | |
|---|---|---|---|---|
| 6,557,530 | B1 | 5/2003 | Benson et al. | |
| 6,823,834 | B2 | 11/2004 | Benson et al. | |
| 6,990,855 | B2 | 1/2006 | Tuken et al. | |
| 7,287,515 | B2 | 10/2007 | Okamura et al. | |
| 7,900,605 | B2 | 3/2011 | Dingle | |
| 8,220,322 | B2 | 7/2012 | Wang et al. | |
| 9,429,093 | B2 | 8/2016 | Empacher et al. | |
| 9,657,680 | B2 | 5/2017 | Surnilla et al. | |
| 9,677,496 | B2 | 6/2017 | Carey et al. | |
| 10,344,703 | B2 | 7/2019 | Nieddu et al. | |
| 11,499,495 | B2 * | 11/2022 | Albing | F02D 41/3845 |
| 2010/0250095 | A1 | 9/2010 | Yamada et al. | |
| 2012/0283934 | A1 | 11/2012 | Topp et al. | |
| 2014/0311453 | A1 | 10/2014 | Christ et al. | |
| 2016/0363104 | A1 * | 12/2016 | Sanborn | F02D 41/401 |
| 2016/0377017 | A1 * | 12/2016 | Basmaji | F02D 41/3094 701/103 |
| 2016/0377018 | A1 * | 12/2016 | Sanborn | F02M 63/029 123/457 |
| 2021/0156332 | A1 * | 5/2021 | Albing | F02D 41/2467 |

OTHER PUBLICATIONS

International Preliminary Report on Patentability received for PCT Patent Application No. PCT/US2018/026874, dated Aug. 22, 2020, 6 pages.

* cited by examiner

SYSTEM AND METHOD FOR MEASURING FUEL INJECTION DURING PUMP OPERATION

CROSS-REFERENCE TO RELATED APPLICATIONS

The present application is a continuation of U.S. application Ser. No. 17/508,475, filed Oct. 22, 2021, which is a continuation of U.S. application Ser. No. 17/046,969, filed Oct. 12, 2020, which is a national phase filing of PCT/US2018/026874, filed Apr. 10, 2018, the complete disclosures of which are expressly incorporated by reference herein.

TECHNICAL FIELD

The present invention relates generally to fuel injection systems and more particularly to methods and systems for measuring fuel injections quantities during normal operation of a fuel pumping system.

BACKGROUND

In internal combustion engines, one or more fuel pumps deliver fuel to a fuel accumulator. Fuel is delivered by fuel injectors from the accumulator to cylinders of the engine for combustion to power operation of the system driven by the engine. It is desirable for a variety of reasons to accurately characterize the amount of fuel delivered by the fuel injectors to the cylinders. In conventional fuel delivery systems, fuel injection quantities are characterized periodically by shutting down the fuel pump and measuring various variables of the fuel delivery system. Such an approach is disruptive to the operation of the engine and provides inaccurate results, in part due to unintended pumping. As such, an improved approach to measuring fuel injection quantities during operation of the pump is needed.

SUMMARY

According to one embodiment, the present disclosure provides a method of controlling operation, of a fuel injector in response to measuring a quantity of fuel injected by the fuel injector from a fuel accumulator to an engine cylinder during operation of a fuel pump that delivers fuel to the accumulator, comprising: determining an average pressure of the fuel accumulator during a first time period before a fuel injection event wherein the fuel injector injects fuel from the fuel accumulator to the engine cylinder; predicting a mass of fuel delivered to the fuel accumulator by the fuel pump during a pumping event (Qpump); determining an average pressure of the fuel accumulator during a second time period after the fuel injection event; estimating a leakage of fuel; computing the quantity of fuel injected by the fuel injector by adding the average pressure during the first time period to Qpump, and subtracting the average pressure during the second time period and the leakage; and using the computed quantity of fuel injected by the fuel injector to control operation of the fuel injector during a subsequent fuel injection event. In one aspect of this embodiment, the pumping event occurs after the first time period and before the fuel injection event. In another aspect, Qpump is zero. In yet another aspect, predicting Qpump includes generating an adaptive model of operation of the fuel pump, including: estimating a start of pumping ("SOP") position of a plunger of the fuel pump, using the estimated SOP position to estimate Qpump, determining a converged value of the estimated SOP position, and determining a converged value of the estimated Qpump; and using the adaptive model to predict Qpump by inputting to the model the converged value of the estimated SOP position, a measured pressure of fuel in the fuel accumulator and a measured temperature of fuel in the fuel accumulator. In a variant of this aspect, estimating a SOP position includes: receiving raw measurements of pressure of fuel in the fuel accumulator; identifying quiet segments in the raw measurements; fitting a model to the identified quiet segments; using the fitted model to determine an output representing a propagation of the pressure of fuel in the fuel accumulator without disturbance from pumping events; and identifying a divergence between the fitted model output and the raw measurements of pressure of fuel in the fuel accumulator. In a further variant, identifying quiet segments includes filtering the raw measurements with a median filter having a length corresponding to a frequency of oscillation of the pressure of fuel in the fuel accumulator. In still a further variant, identifying quiet segments further includes evaluating a derivative of the filtered, raw measurements to identify segments of the derivative having zero slope. In another aspect of this embodiment, the adaptive model uses the relationship Qpump=fcam(EOP−SOP)*A*δ(P,T)−t*L(P,T), wherein fcam is a table correlating positions of the plunger to a crank angle of an engine, EOP is an end of pumping position of the plunger, A is an area of the plunger, δ(P,T) is a density of fuel in the fuel accumulator, t is a duration of the pumping event, and L(P,T) is a leakage of fuel from the pump. In a variant of this aspect, at least one of (P) and (P,T) is modeled by either a first order polynomial in a fuel temperature dimension or at least a second order polynomial in a fuel pressure dimension. In still another aspect, using the computed quantity of fuel injected by the fuel injector to control operation of the fuel injector includes adapting an ON time equation corresponding to the fuel injector.

In another embodiment, the present disclosure provides a system for controlling operation of a fuel injector in response to measuring a quantity of fuel injected by the fuel injector from a fuel accumulator to an engine cylinder during operation of a fuel pump that delivers fuel to the accumulator, comprising: a pressure sensor position to measure pressure of fuel in the fuel accumulator; a temperature sensor positioned to measure temperature of fuel in the fuel accumulator; and a processor in communication with the pressure sensor to receive pressure values representing the measured pressure of the fuel in the fuel accumulator and in communication with the temperature sensor to receive temperature values representing the measured temperature of the fuel in the fuel accumulator; wherein the processor is configured to determine an average pressure of the fuel accumulator during a first time period before a fuel injection event wherein the fuel injector injects fuel from the fuel accumulator to the engine cylinder, predict a mass of fuel delivered to the fuel accumulator by the fuel pump during a pumping event ($Q_{pump}$), determine an average pressure of the fuel accumulator during a second time period after the fuel injection event, estimate a leakage of fuel, compute the quantity of fuel injected by the fuel injector by adding the average pressure during the first time period to $Q_{pump}$ and subtracting the average pressure during the second time period and the leakage, and use the computed quantity of fuel injected by the fuel injector to control operation of the fuel injector during a subsequent fuel injection event. In one aspect of this embodiment, the pumping event occurs after the first time period and before the fuel injection event. In another aspect, $Q_{pump}$ is zero. In still another aspect, the processor is further configured to predict $Q_{pump}$ by generating an adaptive model of operation of the fuel pump by estimating a start of pumping ("SOP") position of a plunger of the fuel pump, using the estimated SOP position to estimate $Q_{pump}$, determining a converged value of the estimated SOP position, and determining a converged value of the estimated $Q_{pump}$; and using the adaptive model to predict $Q_{pump}$ by inputting to the model the converged value of the estimated SOP position, a measured pressure of fuel in the fuel accumulator and a measured temperature of fuel in the fuel accumulator. In a variant of this aspect, the processor is configured to estimate a SOP position by receiving raw measurements of pressure of fuel in the fuel accumulator, identifying quiet segments in the raw measurements, fitting a model to the identified quiet segments, using the fitted model to determine an output representing a propagation of the pressure of fuel in the fuel accumulator without disturbance from pumping events, and identifying a divergence between the fitted model output and the raw measurements of pressure of fuel in the fuel accumulator. In a further variant, the processor is configured to identify quiet segments by filtering the raw measurements with a median filter having a length corresponding to a frequency of oscillation of the pressure of fuel in the fuel accumulator. In another variant, the processor is configured to identify quiet segments by evaluating a derivative of the filtered raw measurements to identify segments of the derivative having approximately zero slope. In another aspect of the present disclosure, the adaptive model uses the relationship $Qpump=fcam(EOP-SOP)*A*\delta(P,T)-t*L(P,T)$, wherein fcam is a table correlating positions of the plunger to a crank angle of an engine, FOP is an end of pumping position of the plunger, A is an area of the plunger, $\delta(P,T)$ is a density of fuel in the fuel accumulator, t is a duration of the pumping event, and L(P,T) is a leakage of fuel from the pump. In a variant of this aspect, at least one of (P) and (P,T) is modeled by either a first order polynomial in a fuel temperature dimension or at least a second order polynomial in a fuel pressure dimension. In another aspect, the processor is configured to use the computed quantity of fuel injected by the fuel injector to control operation of the fuel injector by adapting an ON time equation corresponding to the fuel injector.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

BRIEF DESCRIPTION OF THE DRAWINGS

The above-mentioned and other features of this disclosure and the manner of obtaining them will become more apparent and the disclosure itself will be better understood by reference to the following description of embodiments of the present disclosure taken in conjunction with the accompanying drawings, wherein.

Figure 1:
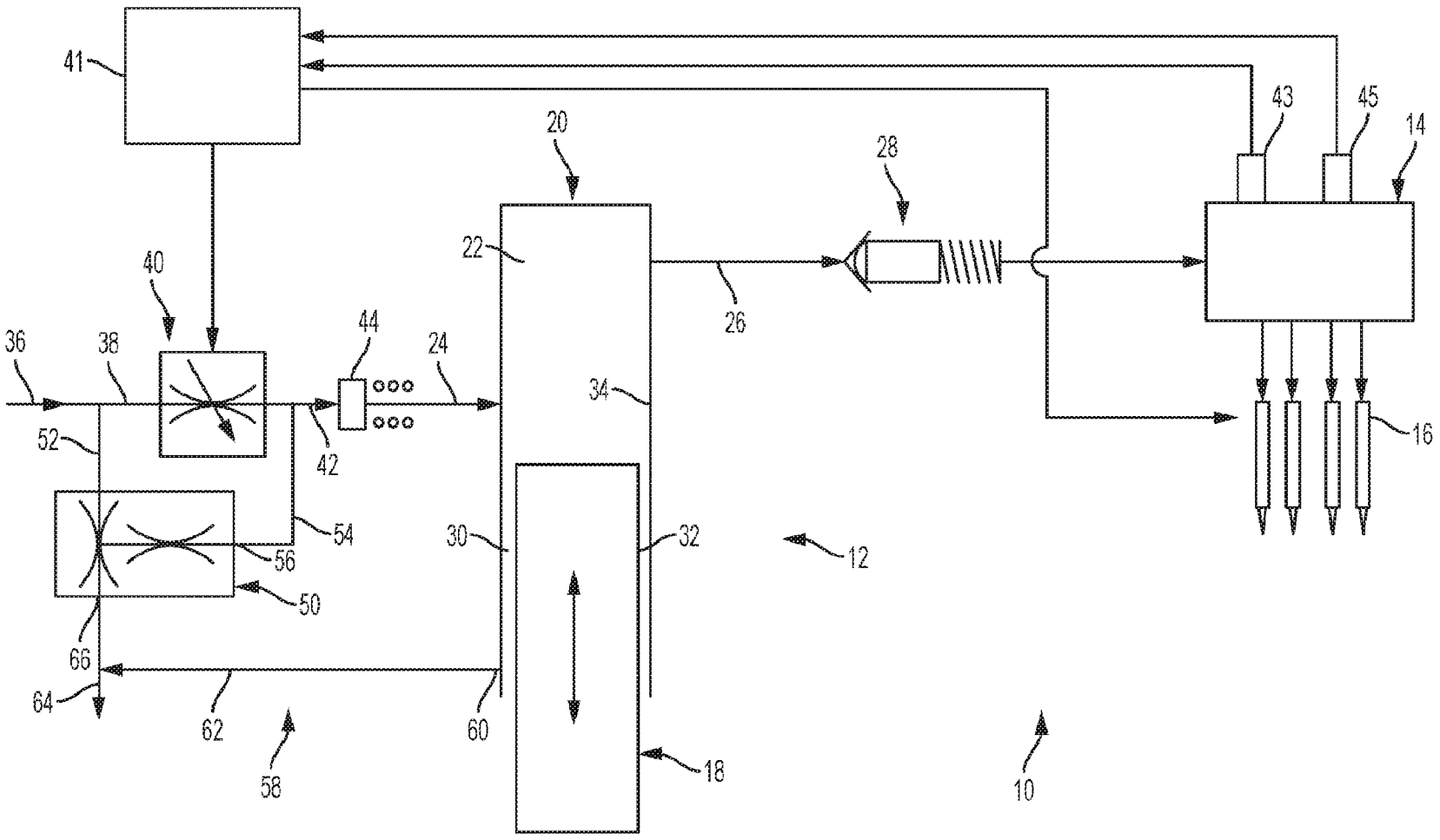
FIG. 1 is a schematic diagram of a fueling system.

While the present disclosure is amenable to various modifications and alternative forms, specific embodiments have been shown by way of example in the drawings and are described in detail below. The present disclosure, however, is not to limit the particular embodiments described. On the contrary, the present disclosure is intended to cover all modifications, equivalents, and alternatives falling within the scope of the appended claims.

DETAILED DESCRIPTION

One of ordinary skill in the art will realize that the embodiments provided can be implemented in hardware, software, firmware, and/or a combination thereof. For example, the controllers disclosed herein may form a portion of a processing subsystem including one or more computing devices having memory, processing, and communication hardware. The controllers may be a single device or a distributed device, and the functions of the controllers may be performed by hardware and/or as computer instructions on a non-transient computer readable storage medium. For example, the computer instructions or programming code in the controller (e.g., an electronic control module ("ECM")) may be implemented in any viable programming language such as C, C++, HTML, XTML, JAVA or any other viable high-level programming language, or a combination of a high-level programming language and a lower level programming language.

As used herein, the modifier "about" used in connection with a quantity is inclusive of the stated value and has the meaning dictated by the context (for example, it includes at least the degree of error associated with the measurement of the particular quantity). When used in the context of a range, the modifier "about" should also be considered as disclosing the range defined by the absolute values of the two endpoints. For example, the range "from about 2 to about 4" also discloses the range "from 2 to 4."

Referring now to FIG. 1, a schematic diagram of a portion of a fueling system for an engine is shown. Fueling system 10 generally includes a high pressure pump 12, a fuel reservoir, such as a common rail accumulator (hereinafter, rail 14) and a plurality of fuel injectors 16. Pump 12 includes a plunger 18 that reciprocates within a barrel 20 as is known in the art. In general, fuel is supplied to a chamber 22 within barrel 20 through an inlet 24, compressed by upward motion of plunger 18 such that the pressure of the fuel is increased, and supplied through an outlet 26 to an outlet check valve (OCV) 28 and from there, to rail 14. Fuel from rail 14 is periodically delivered by fuel injectors 16 to a corresponding plurality of cylinders (not shown) of an internal combustion engine (not shown). A small circumferential gap 30 exists between an outer surface 32 of plunger 18 and an inner surface 34 of barrel 20 to permit reciprocal motion of plunger 18 within barrel 20.

Fuel is provided from a fuel supply 36 into a supply line 38. Fuel supply 36 may include a low pressure fuel transfer pump (not shown). A hydro mechanical actuator (hereinafter, inlet metering valve or "IMV" 40) is configured to control the quantity of fuel dispersed to high pressure fuel pump 12. While only one high pressure fuel pump 12 is shown, it is understood that, any number of high pressure fuel pumps 12 may be used in various applications. Embodiments of the fuel pump 12 design may include a floating plunger pump, a positive displacement pump or retracted plunger pump design or other suitable design for pumping pressurized fuel in a high pressure fuel pump system.

IMV 40 may include a variable area orifice operated, for example, by a solenoid to control the amount of fuel to be pumped. IMV 40 may be commanded by a processor 41 to be fully closed to prevent fuel being passed to fuel pump 12 from the supply line 38. Yet, by nature of the valve, there may be a natural leakage rate that passes through the clearance of components of the valve and into an inlet check valve passage 42 upstream of an inlet check valve 44. Upon sufficient pressurization of fuel within inlet check valve passage 42, the tolerance pressure of check valve 44 may be achieved and the leakage fuel flow may be admitted to fuel pump 12 through inlet 24. This may result in over-pressurization of the leakage fuel flow.

The present disclosure may further include a venturi apparatus 50 disposed within a continuous fuel flow circuit. The fuel flow circuit includes a supply line 52 having one end fluidly connected to the venturi apparatus 50. The other end of the supply line 52 is disposed upstream to IMV 40 in fluid connection with supply line 38. Supply line 52 in connection with the venturi apparatus 50 acts as an air bleed orifice to disperse air from within the supply line 38 upstream to IMV 40. The fuel flow circuit further includes an inlet venturi passage 54 having one end fluidly connected to venturi apparatus 50 at inlet 56. The other end of inlet venturi passage 54 is disposed downstream to IMV 40 in fluid connection with inlet check valve passage 42. As shown in FIG. 1, ends of supply line 52 and inlet venturi passage 54 are fluidly connected to supply line 38 and inlet check valve passage 42, respectively, and are disposed upstream to pump 12.

A fuel pump drain circuit 58 is provided which, in one embodiment, connects a fuel pump drain 60 to a fuel drain supply line 62. Fuel drain supply line 62 may be fluidly connected to a fuel drain 64 of a fuel tank (not shown). In a preferred embodiment, the fuel flow circuit comprises an output 66 of venturi apparatus 50 which is fluidly connected to fuel drain supply line 62. As further described below, the disclosed venturi apparatus 50 enables fuel within the fuel drain supply line 62 to flow toward fuel drain 64 and away from pump 12.

Venturi apparatus 50 utilizes the continuous fuel flow circuit, including the portion that is upstream of IMV 40. In one embodiment, this includes the portion of the continuous fuel flow circuit that is immediately upstream of IMV 40 to form a low pressure region within the throttling area of venturi apparatus 50. The continuous fuel flow circuit connects the low pressure zone of venturi apparatus 50 to the inlet metering circuit of pump 12. Venturi apparatus 50 causes leakage of fuel flow from IMV 40 to be directed back toward fuel drain 64, and away from pump 12, so that the leakage of fuel flow is not pressurized by pump 12. By design, the disclosed venturi apparatus 50 combines the functions of a vapor removing bypass flowing upstream of IMV 40 and removal of the leakage of fuel flow from IMV 40 downstream of the fully closed IMV 40.

As plunger 18 moves through the pumping cycle, it moves between a start-of-pumping (SOP) position and an end-of-pumping (EOP) position. The SOP position is after plunger 18 moves through its bottom-dead-center (BDC) position and the EOP position precedes the top-dead-center (TDC) position of plunger 18.

During the compression stroke of plunger 18 (i.e., as it moves from the BDC position to the TDC position), fuel in chamber 22 is compressed, causing the pressure in chamber 22 to increase to a point where the force on the chamber side of OCV 28 is equal to the force on the rail side of OCV 28. As a result, OCV 28 opens and fuel begins to flow through outlet 26 and OCV 28 to rail 14. Fuel continues to flow in this manner to rail 14 as plunger 18 continues to travel toward the TDC position. Consequently, the pressure of fuel in rail 14 increases. Conversely, when fuel injectors 16, under the control of processor 41, deliver fuel from rail 14 to the cylinders for combustion, the pressure of fuel in rail 14 decreases. The present disclosure provides a method of estimating the injected quantity of fuel for each fuel injector 16 while fuel pump 12 is in operation.

The fuel pump assemblies known from the prior art have the disadvantage that at certain operating points, and particularly in so-called zero pumping, when pump 12 requires no fuel quantity and IMV 40 is closed, a slight unintended pumping can still occur. Depending on how IMV 40 functions, the unintended pumping is caused for instance by leakage or measurement errors on the part of IMV 40 and can hardly be avoided despite major technological efforts to counteract it. If the unintended pumping is too frequent, it may prevent the gathering of sufficient measurements to assess the performance of injectors 16. Such assessment of injectors 16 is often necessary to comply with applicable emissions regulations. As such, in some prior art systems where sufficient injector measurements are not possible, pump 12 is flagged as being defective and a fault indicator is provided to the user. The system and method of the present disclosure, however, is not sensitive to the above-described self-pumping and should eliminate such fault indications.

According to the present disclosure, the quantity of fuel injected by injectors 16 may be measured by calculating the pressure drop due to injection and converting the pressure drop to mass using the following equation:

$$Q = \frac{V}{c^2}\Delta P \tag{1}$$

where V is the pressurized volume, $c^2$ is the sonic speed, $\Delta P$ is the pressure drop and Q is the injected quantity. $\Delta P$ may be determined by processor 41 by comparing measurements from a pressure sensor 43 before and after a fuel injection by one of injectors 16. Pressure sensor 43 is disposed downstream of OCV 28 and configured to sense the pressure of fuel in rail 14. The easiest case is when the mass balance of the system is determined only by the injections. However, there two other components that can influence pressure drop as described below.

First, system leakage can influence pressure drop. System leakage is a continuous leakage from the high pressure system to the low pressure side through non-ideal seals as indicated above. The leakage has the unit bat's and is denoted L. As described below, the variable t (time) when multiplied by L gives the pressure drop due to leakage during a segment of time under consideration.

The amount of fuel pumped to rail 14 also influences the pressure drop in rail 14. The mass removed from rail 14 due to injection by fuel injectors 16 and by leakage needs to be replaced to maintain a desired rail pressure. Pump 12 provides this mass. The pumped mass has the unit bar or mass, depending upon whether it is considered in the pressure domain or the mass domain. The conversion from one domain to the other is done using the relationship set forth above in equation (1).

Using the above-described assumptions, the observed rail pressure is represented by the sum of the injection, the pumped mass by pump 12 and the system leakage. If two of these variables are known, the third can be estimated by subtracting the known values from the rail pressure signal. Assuming the system leakage and pumped mass are predictable values using inputs available in real time, the injected quantity can be estimated. The model below also assumes that the mean pressure of an available stationary rail pressure segment may be determined, given sufficient data length with no injection or pumping occurring.

Figure 2:
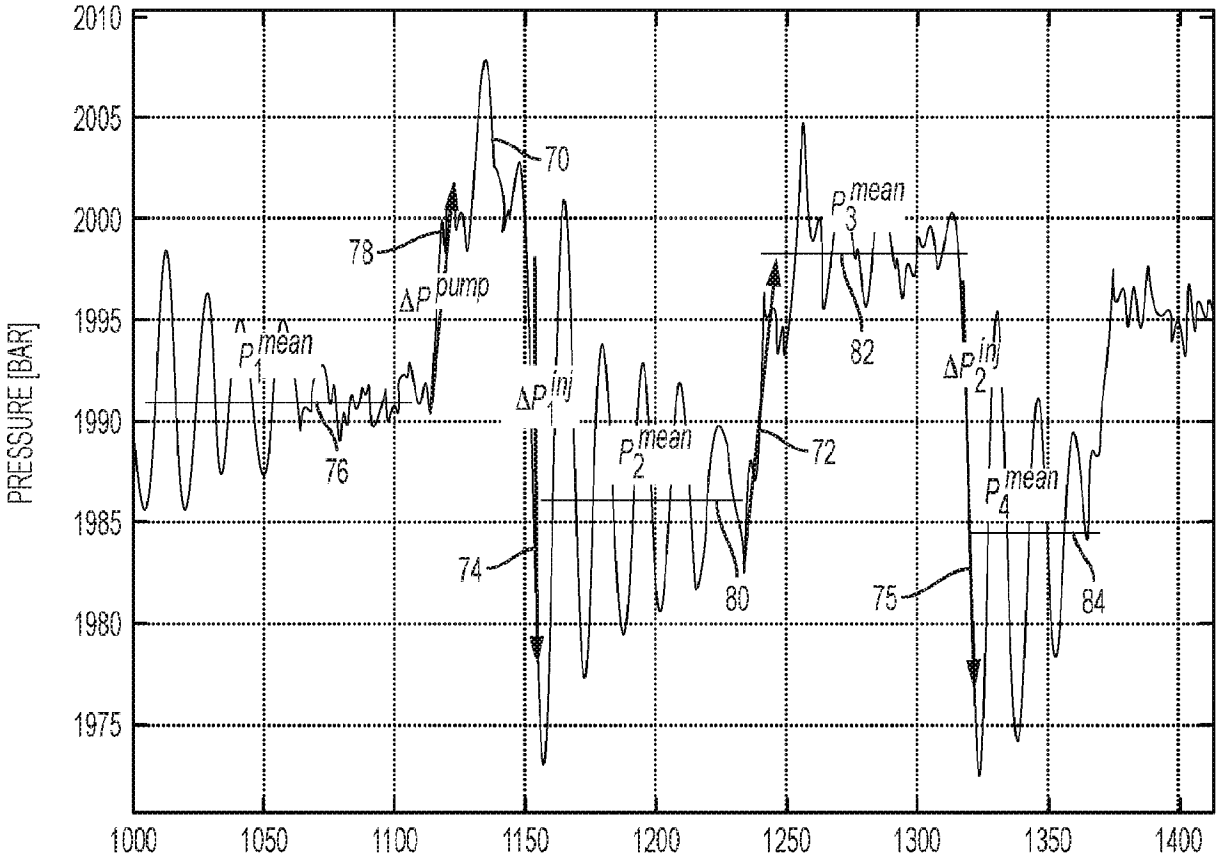
FIG. 2 is a graph showing measured and mean rail pressure of a common rail accumulator.

Referring now to FIG. 2, trace 70 is the fuel pressure in rail 14 as measured by pressure sensor 43 and read by processor 41. The rail pressure of trace 70 increases during a pumping event (as indicated, for example, by arrow 78) and decreases during an injection event (as indicated, for example, by arrow 74). The system leakage is usually too small to be seen in a graph similar to FIG. 2, but large enough in many cases to impact the accuracy of the estimation of injected quantity if not taken into account.

As is further discussed below, trace 70 depicts two different cases of timing between a pumping event and an injection event. Specifically, in the first case, the first pumping event indicated by arrow 78 is adjacent in time to the first injection event indicated by arrow 74. The two events are not separated by an average rail pressure computation. In the second case, the second pumping event indicated by arrow 72 is isolated from the second injection event indicated by arrow 75. An average rail pressure computation separates the two events. In FIG. 2, the two injections ($\Delta P_1^{inj}$ and $\Delta P_2^{inj}$) indicated by arrows 74, 75 occur during an overall time period of 400 data samples.

As indicated above, regarding the first injection event, $\Delta P_1^{inj}$ 74, pumping event $\Delta P^{pump}$ 74 occurs in close temporal proximity to $\Delta P_1^{inj}$, making the determination of the average pressure before the first injection difficult. It should be noted that in some instances, the pumping event could even occur substantially simultaneously with the injection event, entirely masking the pressure drop.

Referring again to FIG. 2, the average pressure before, pumping event 78 (i.e., $P_1^{mean}$ 76) and the predicted pumping $\Delta P^{pump}$ 78 are determined. These quantities are determined using the adaptation algorithm for estimating mass pumped by pump 12 described in in co-pending patent application, entitled "ADAPTIVE HIGH PRESSURE FUEL PUMP SYSTEM AND METHOD FOR PREDICTING PUMPED MASS," filed on Apr. 10, 2018, attorney docket no. CI-17-0699-01-WO, (hereinafter, "the Adaptation Application"), the entire disclosure of which being expressly incorporated herein by reference. Using the principles described in the Adaptation Algorithm, the pumped fuel mass is measured. Then, the pressure and temperature of fuel in rail 14 are identified at the start of pumping ("SOP") (i.e., the start of arrow 74) to predict the pumped mass for pumping event 78. The SOP is determined as explained in the Adaptation Application by adapting a model to the pump and finding a convergence of the model, which indicates the SOP. The pressure of rail 14 is measured by pressure sensor 43 and the temperature of fuel in rail 14 is measured by a temperature sensor 45 disposed in operational proximity to rail 14. More specifically, the equation Qpump=fcam(EOP−SOP)*A*δ(P,T)−t*L(P,T) from the Adaptation Application is used to determine δ, L and EOP. Knowing those values, here we can determine SOP and from that we can determine the magnitude of pumping event 78. It should be understood that while the pumping prediction of the Adaptation Application is mass, the pressure values depicted in FIG. 2 are easily derived using standard relationships commonly known in the art. Using these terms and the estimated average pressure after injection, $P_2^{mean}$ 80, the pressure drop due to injection is calculated using the equation:

$$\Delta P_1^{inj}=P_1^{mean}-P_2^{mean}+\Delta P^{pump}-tL \tag{2}$$

For the second injection, $\Delta P_2^{inj}$, the mean pressure before the injection, $P_3^{mean}$ 82, and the mean pressure after the injection, $P_4^{mean}$ 84, are available, and no pumping event prediction is needed because no pumping event occurred before or during $\Delta P_2^{inj}$ (i.e., $\Delta P^{pump}=0$ in Equation (2). Thus, the pressure drop due to the second injection event is calculated using the equation:

$$\Delta P_2^{inj}=P_3^{mean}-P_4^{mean}-tL \tag{3}$$

Using the approach set forth above, fuel injection quantities may be determined accurately without shutting down pump 12. Using previous approaches, the pump 12 was commanded to pump zero mass and measurements of fuel injections were then performed. However, as a result of imperfections in the pumping system, small pumping events occurred during these measurements, causing offsets that affected the accuracy of the measurements. With the approach of the present disclosure, fuel injection measurements are obtained during intended operation of pump 12 without the inaccuracies caused by unintended pumping. This also permits the collection of more data on fuel injectors 16 as there is no need to wait for pump 12 to reach zero mass pumped. While historically fuel injection measurements were performed perhaps once per minute (or some other time period appropriate for the demands of the application), using the approach of the present disclosure which does not disable pump 12, only the processing power of processor 41 limits the amount of data that can be acquired to perform fuel injection measurements.

The fuel injection measurements/estimates provided by the present disclosure are used by processor 41 to, among other things, adapt the ON time equations for fuel injectors 16. Specifically, the injector ON time equations describe the relationship between the ON time, the rail pressure and the fuel injection quantities, and are used to improve fueling accuracy as is known in the art. As the approach of the present disclosure accounts for hardware anomalies such as injector hole obstructions and manufacturing tolerances, it can also provide improved fuel economy and emissions performance.

It should be understood that, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements. The scope is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B or C may be present in a single embodiment; for example, A and B, A and C, B and C, or A and B and C.

In the detailed description herein, references to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not, necessarily referring to the same embodiment. Further, when a particular feature, structure, or characteristic is described in connection with an embodiment, it is submitted that it is within the knowledge of one skilled in the art with the benefit of the present disclosure to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the described features. Accordingly, the scope of the present disclosure is intended to embrace all such alternatives, modifications, and variations as fall within the scope of the claims, together with all equivalents thereof.

What is claimed is:

1. A method of controlling operation of a fuel injector in response to measuring a quantity of fuel injected by the fuel injector from a fuel accumulator during operation of a fuel pump that delivers fuel to the accumulator, comprising:

determining a change in pressure value of the fuel accumulator before and after a fuel injection event;

predicting an amount of fuel delivered to the fuel accumulator by the fuel pump during a pumping event (Qpump) and an amount of fuel leakage;

computing the quantity of fuel injected by the fuel injector by adding the change in pressure value to Qpump, and subtracting the amount of fuel leakage; and using the computed quantity of fuel injected by the fuel injector to control operation of the fuel injector during a subsequent fuel injection event.

2. The method of claim 1, wherein the pumping event occurs before the fuel injection event.

3. The method of claim 1, wherein Qpump is zero.

4. The method of claim 1, wherein predicting Qpump includes generating an adaptive model of operation of the fuel pump, including:

estimating a start of pumping ("SOP") position of a plunger of the fuel pump, using the estimated SOP position to estimate Qpump, determining a converged value of the estimated SOP position, and determining a converged value of the estimated Upump; and using the adaptive model to predict Qpump by inputting to the model the converged value of the estimated SOP position, a measured pressure of fuel in the fuel accumulator and a measured temperature of fuel in the fuel accumulator.

5. The method of claim 4, wherein estimating a SOP position includes:

receiving raw measurements of pressure of fuel in the fuel accumulator:

identifying quiet segments in the raw measurements;

fitting a model to the identified quiet segments; using the fitted model to determine an output representing a propagation of the pressure of fuel in the fuel accumulator without disturbance from pumping events; and identifying a divergence between the fitted model output and the raw measurements of pressure of fuel in the fuel accumulator.

6. The method of claim 5, wherein identifying quiet segments includes filtering the raw measurements with a median filter having a length corresponding to a frequency of oscillation of the pressure of fuel in the fuel accumulator.

7. The method of claim 5, wherein identifying quiet segments further includes evaluating a derivative of the filtered raw measurements to identify segments of the derivative having approximately zero slope.

8. The method of claim 4, wherein the adaptive model uses the relationship $Qpump=fcam(EOP-SOP)*A*\delta(P, T)-t*L(P, T)$, wherein fcam is a table correlating positions of the plunger to a crank angle of an engine, EOP is an end of pumping position of the plunger, A is an area of the plunger, $\delta(P, T)$ is a density of fuel in the fuel accumulator, t is a duration of the pumping event, and L(P,T) is a leakage of fuel from the pump.

9. The method of claim 8, wherein at least one of $\delta(P, T)$ and L(P,T) is modeled by either a first order polynomial in a fuel temperature dimension or at least a second order polynomial in a fuel pressure dimension.

10. The method of claim 1, wherein using the computed quantity of fuel injected by the fuel injector to control operation of the fuel injector includes adapting an ON time equation corresponding to the fuel injector.

11. A processor for controlling operation of a fuel injector in response to measuring a quantity of fuel injected by the fuel injector during operation of a fuel pump that delivers fuel to a fuel accumulator, the processor configured to:

receive, from a pressure sensor; pressure values representing a measured pressure of fuel in the fuel accumulator before and after a fuel injection event;

determine a change in pressure value of the fuel accumulator from the received pressure values;

predict an amount of fuel delivered, to the fuel accumulator by the fuel pump during a pumping event (Qpump) and an amount of fuel leakage;

compute the quantity of fuel injected by the fuel injector by adding the change in pressure value to Qpump, and subtracting the leakage; and use the computed quantity of fuel injected by the fuel injector to control operation of the fuel injector during a subsequent fuel injection event.

12. The processor of claim 11, wherein the pumping event occurs before the fuel injection event.

13. The processor of claim 11, wherein Qpump is zero.

14. The processor of claim 11, further configured to:

estimate a start of pumping ("SOP") position of a plunger of the fuel pump;

estimate Qpump using the estimated SOP position;

determine a converged value of the estimated SOP position;

determine a converged value of the estimated Qpump; and generate an adaptive model of operation of the fuel pump, wherein the model is used to predict Qpump by inputting to the model the converged value of the estimated SOP position, a measured pressure of fuel in the fuel accumulator and a measured temperature of fuel in the fuel accumulator.

15. The processor of claim 14, wherein the processor is configured to estimate the SOP position by:

receiving raw measurements of pressure of fuel in the fuel accumulator;

identifying quiet segments in the raw measurements;

fitting a model to the identified quiet segments;

using the fitted model to determine an output representing a propagation of the pressure of fuel in the fuel accumulator without disturbance from pumping events; and identifying a divergence between the fitted model output and the raw measurements of pressure of fuel in the fuel accumulator.

16. The processor of claim 15, further configured to identify quiet segments by filtering the raw measurements with a median filter having a length corresponding to a frequency of oscillation of the pressure of fuel in the fuel accumulator.

17. The processor of claim 15, further configured to identify quiet segments by evaluating a derivative of the filtered raw measurements to identify segments of the derivative having approximately zero slope.

18. The processor of claim 14, wherein the adaptive model uses the relationship $Qpump=fcam(EOP-SOP)*A*\delta(P, T)-t*L(P, T)$, wherein fcam is a table correlating positions of the plunger to a crank angle of an engine, EOP is an end of pumping position of the plunger, A is an area of the plunger, $\delta(P, T)$ is a density of fuel in the fuel accumulator, t is a duration of the pumping event, and $L(P, T)$ is a leakage of fuel from the pump.

19. The processor of claim 18, wherein at least one of $\delta(P, T)$ and $L(P, T)$ is modeled by either a first order polynomial in a fuel temperature dimension or at least a second order polynomial in a fuel pressure dimension.

20. The processor of claim 11, further configured to use the computed quantity of fuel injected by the fuel injector to control operation of the fuel injector by adapting an ON time equation corresponding to the fuel injector.

21. A system for controlling operation of a fuel injector in response to measuring a quantity of fuel injected by the fuel injector from a fuel accumulator during operation of a fuel pump that delivers fuel to the accumulator, comprising:

a pressure sensor positioned to measure pressure of fuel in the fuel accumulator; and a processor in communication with the pressure sensor and configured to:

receive, from the pressure sensor, pressure values representing the measured pressure of the fuel in the fuel accumulator before and after a fuel injection event;

determine a change in pressure value of the fuel accumulator from the received pressure values;

predict an amount of fuel delivered to the fuel accumulator by the fuel pump during a pumping event (Qpump) and an amount of fuel leakage;

compute the quantity of fuel injected by the fuel injector by adding the change in pressure value to Qpump, and subtracting the amount of fuel leakage; and use the computed quantity of fuel injected by the fuel injector to control operation of the fuel injector during a subsequent fuel injection event.

* * * * *